United States Patent [19]

Fischer, Sr. et al.

[11] 4,153,956

[45] May 15, 1979

[54] TOILET DEODORIZER DEVICE

[76] Inventors: Raymond C. Fischer, Sr., 525 Foster St., Marlin, Tex. 76661; Raymond C. Fischer, Jr., R.R. #3, Box 135, Denton, Md. 21629

[21] Appl. No.: 861,849

[22] Filed: Dec. 15, 1977

[51] Int. Cl.[2] ..... E03D 9/04; F24H 3/04

[52] U.S. Cl. ..... 4/213; 4/347; 219/370

[58] Field of Search ..... 4/209, 213, 216, 217, 4/347, 348, 352, 353, 211, 218; 219/370; 310/187–189; 415/121 G; 98/43 R, 116

[56] References Cited

U.S. PATENT DOCUMENTS

| | | | |
|---|---|---|---|
| 2,309,885 | 2/1943 | Carman | 219/370 |
| 2,359,176 | 9/1944 | Walz | 310/88 |
| 3,763,505 | 10/1973 | Zimmerman | 4/216 X |
| 3,781,923 | 1/1974 | Maisch et al. | 4/213 |
| 4,017,916 | 4/1977 | Pearson | 4/213 |

FOREIGN PATENT DOCUMENTS

| | | | |
|---|---|---|---|
| 2249747 | 4/1974 | Fed. Rep. of Germany | 4/209 |

*Primary Examiner*—Stuart S. Levy

*Attorney, Agent, or Firm*—Clarence A. O'Brien; Harvey B. Jacobson

[57] ABSTRACT

A toilet deodorizer device having a flow inducing and odor removing assembly arrangeable in the upper portion of a toilet tank for drawing air from the rim portion of a toilet bowl associated with the tank upwardly through a conventional overflow pipe provided in the tank for exhaust at the top of the tank. The flow inducing and odor removing assembly is supported in the upper portion of the toilet tank by a diaphragm constructed from a gas permeable material which permits the air being deodorized to pass through the diaphragm. Resting on the diaphragm is a fan and heater unit including a blower which draws the air through the toilet tank, and a heater disposed at the outlet of the blower for deodorizing the air by the application of extreme heat.

7 Claims, 5 Drawing Figures

TOILET DEODORIZER DEVICE

BACKGROUND OF THE INVENTION

1. Field of the Invention

This invention relates generally to a toilet deodorizing device, and particularly to apparatus which can be readily adapted for use with conventional toilets to provide an effective and efficient deodorizing system.

2. Description of the Prior Art

Toilet deodorizers normally are of a chemical type which either perfumes the air or absorbs the odor associated with use of the toilet. In some devices, the odors are reduced because the waste material is burned. These known devices are either short lived and need frequent replacement, or are not easily adapted to the common household toilet.

Examples of toilet deodorizing systems in which toilet odors are drawn from the toilet bowl through water in the toilet tank and are exhausted through a deodorizing device disposed at the upper portion of the toilet tank can be found in U.S. Pat. Nos: 3,763,505, issued Oct. 9, 1973, to J. P. Zimmerman; 3,781,923, issued Jan. 1, 1974, to H. Maisch, et al.; and 3,939,506, issued Feb. 24, 2976, to R. H. Pearson. Of these known systems, the first two cited require specially constructed tank covers which replace the standard cover, while the latter device requires part of the system to be disposed in the attic space of a structure associated with the toilet.

SUMMARY OF THE INVENTION

It is an object of the present invention to provide a toilet deodorizing device of inexpensive construction which can be adapted to toilets of conventional construction and as commonly found in homes and other structures.

It is another object of the present invention to provide a toilet deodorizing device which removes odors from toilet fumes by passing the fumes over a heating element mounted in the water tank of the toilet.

A still further object of the present invention is to provide a toilet deodorizing device which uses heat to remove odors from toilet fumes.

These and other objects are achieved according to the present invention by providing a toilet deodorizing device having: a flow inducing and odor removing assembly arrangeable in the upper portion of a toilet tank for drawing toilet fumes from a toilet bowl associated with the tank into and upwardly through the toilet tank; and a retainer arrangement mountable on the toilet tank for supporting the flow inducing and odor removing assembly in the upper portion of the toilet tank.

The retainer arrangement preferably includes a diaphragm arrangeable extending across and blocking the open top of the toilet tank, the flow inducing and odor removing assembly being at least partly disposed on the diaphragm for support thereby. The retainer arrangement advantageously further includes an open framework shaped from a longitudinally extending member of bendable material to conform to the top periphery of the toilet tank and be supported thereon, with the diaphragm being secured in position by the framework. This framework also forms a seal between the diaphragm and toilet tank.

The retainer arrangement advantageously still further includes spacers in the form of a plurality of rectangular blocks attached to the framework for spacing a cover of the toilet tank from the framework and forming a gap between the cover and tank for exhausting deodorized fumes and other gases from the toilet tank.

The flow inducing and odor removing assembly preferably includes: a fan; a heater associated with the fan, the fan and heater advantageously forming a single unit disposed on the diaphragm; a switch mountable on a flush lever of the toilet tank and connected to the fan and heater unit for actuating the unit when the toilet is flushed; and a control system connected to the fan and heater for determining the length of time the fan and heater operate once actuated.

Advantageously, the fan is a centrifugal blower having an inlet and an outlet, with the heater comprising an electrical heating element disposed at the outlet of the bowl for deodorizing by heat the fumes being discharged from the blower.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
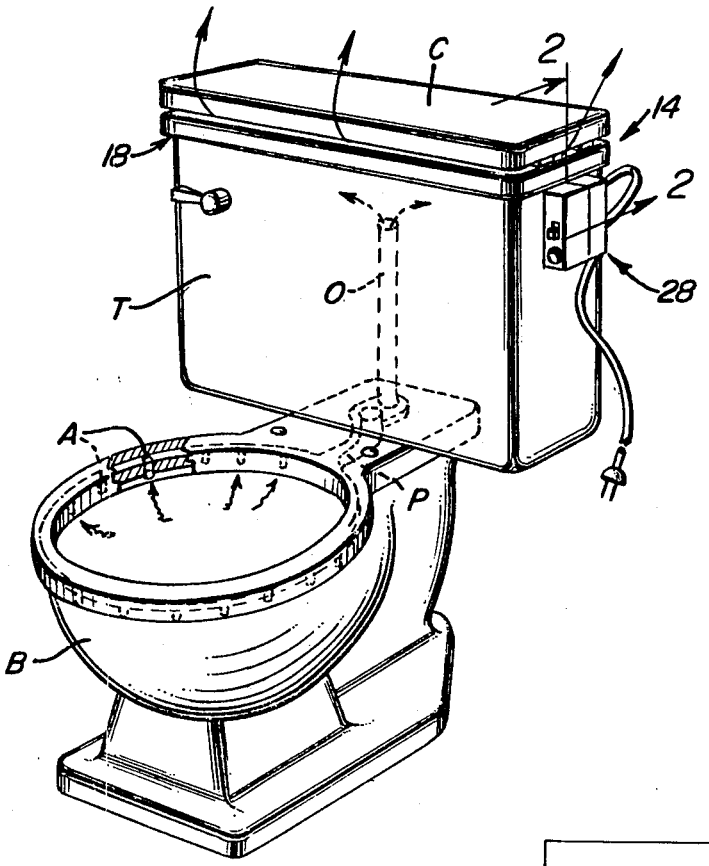
FIG. 1 is a schematic, perspective view showing a toilet deodorizing device mounted on a conventional toilet.
Figure 2:
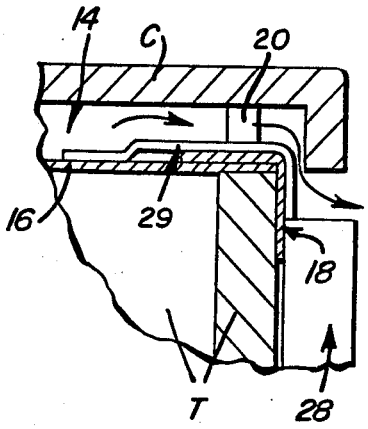
FIG. 2 is an enlarged, fragmentary, sectional view taken generally along the line 2—2 of FIG. 1.
Figure 3:
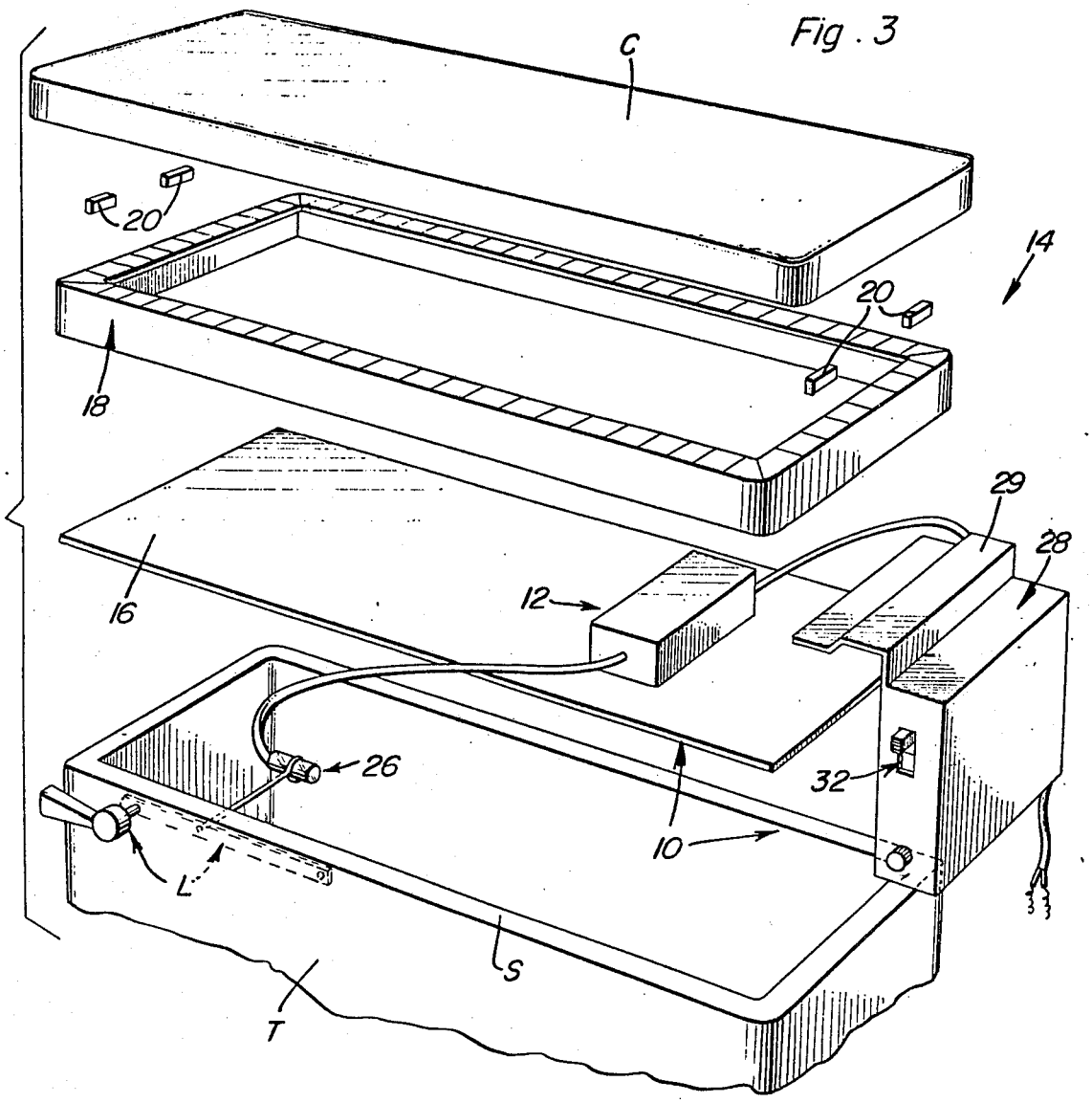
FIG. 3 is an enlarged, fragmentary, exploded perspective view showing the upper portion of the arrangement seen in FIG. 1.

Referring now more particularly to FIGS. 1 through 3 of the drawings, a toilet deodorizer device 10 according to the present invention includes a flow inducing and odor removing unit 12 shown arranged in the upper portion of a conventional toilet tank T for drawing fumes through apertures A in a toilet bowl B, a flow passage P, and upwardly through tank T by means of the conventional overflow pipe O. Mounted on the upper rim portion of tank T for supporting unit 12 is a retainer 14 in accordance with the invention.

Retainer 14 includes a diaphragm 16 constructed from a preferably flexible, gas permeable material and arrangeable extending across and blocking the open top of tank T. The unit 12 is disposed on diaphragm 16 for support thereby.

Retainer 14 further includes an open framework 18 formed from a longitudinally extending strip of suitable material, preferably constructed from a suitable synthetic resin, which has a cross section in the shape of a right angle so as to conform to the outer rim portion of the top of tank T in such a manner as to seal diaphragm 16 with respect to tank T. More specifically, as can be seen best in FIG. 2, framework 18 will secure the peripheral portions of diaphragm 16 to the upper edge of tank T in such a manner as to form a seal with respect to the tank T and diaphragm 16. Mounted on the serrated face of framework 18 are a plurality of pads 20 in the shape of rectangular blocks which permit the cover C of tank T to be spaced therefrom so as to form a gap between cover C and tank T for exhausting deodorized gases from tank T.

Figure 4:
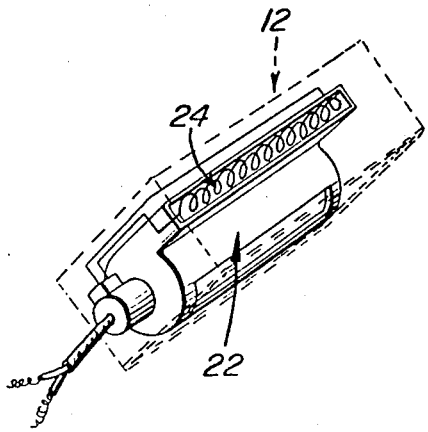
FIG. 4 is a perspective view, partly in phantom lines for clarity, showing a fan and heater unit forming part of a toilet deodorizer device according to the present invention.

Unit 12 advantageously includes a fan in the form of centrifugal blower 22 having an inlet and an outlet, with an electrical heater element 24 of conventional construction being disposed at the outlet of blower 22 for subjecting a gas discharged from blower 22 to sufficient heat to achieve deodorization of noxious fumes carried by the gas medium in a manner known per se. Blower 22 and heater 24 are connected to a mercury switch 26 by an electrical circuit to be described below, which switch 26 is mountable on a flush lever L of toilet tank T for de-actuation of unit 12 when the toilet is flushed by suitable manipulation of lever L in a known manner in order to actuate a conventional flush valve (not shown). The arrangement of blower 22 and heater 24 is perhaps best seen in FIG. 4 of the drawings, wherefrom it will be appreciated the novel and efficient arrangement of the operating portions of the flow inducing and deodorizing system, in accordance with the invention.

The flow inducing and deodorizing system also includes control circuitry, to be described below in conjunction with FIG. 5, which is housed in a control box 28 mounted on the side of toilet tank T, and more specifically on the serrated upper surface of framework 18 as by the illustrated flange-like bracket 29 configured so as to conform to the surface formed by diaphragm 16 and framework 18 at a peripheral portion of tank T.

Figure 5:
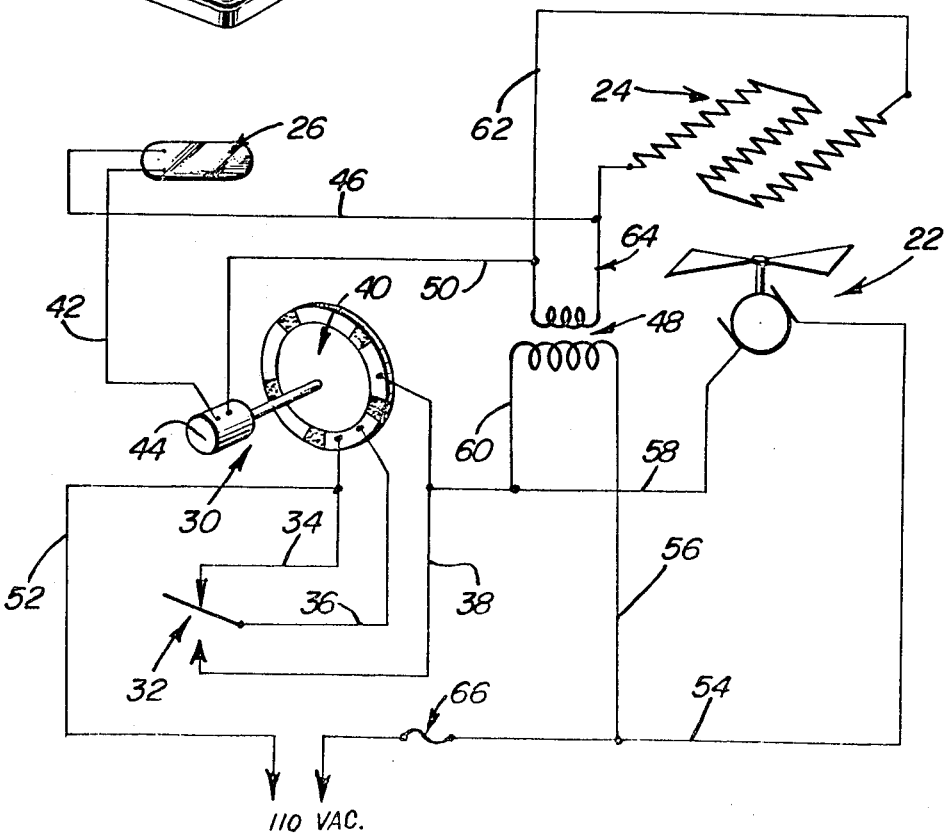
FIG. 5 is a schematic diagram showing the electrical circuit which controls operation of a toilet deodorizer device according to the present invention.

Referring now more specifically to FIG. 5 of the drawings, the construction of a control circuit for unit 12 will now be described. Disposed within control box 28 is a conventional rotary solenoid switch 30 connected to a single pole double throw switch 32, also of conventional construction, as by the wires 34, 36 and 38. These wires are placed in sliding contact by conventional techniques, not shown, of the contacts of a contact disk 40 of switch 30 so as to wipe such contacts and the gaps therebetween in an appropriate manner to selectively deenergize blower 22 and heater 24. Mercury switch 26 is connected by a wire 42 to solenoid 44 of switch 30 and by wire 46 to the secondary of a conventional step-down transformer 48. The secondary of transformer 48 is connected to solenoid 44 as by a wire 50, while a circuit is completed by a wire 52 connecting wire 34 to one side of a conventional source of electric power, such as a household electrical outlet, with a wire 54 connecting the other side of such source of electric power to the primary of transformer 48, by a wire 56, and to blower 22. The latter is connected to wire 38 by a wire 58 which also is electrically connected to the other side of the primary of transformer 48 by the illustrated wire 60. Wires 62 and 64 connect the secondary of transformer 48 to heater 24. A conventional fuse 66 is peferably inserted in wire 54 as a safety device in the conventional manner.

In operation, mercury switch 26 is the device employed by flush lever L to cause rotary solenoid switch 30 to operate. When flush lever L is tilted, mercury switch 26 closes causing the electrical circuit shown in FIG. 5 to be completed to the rotary solenoid switch 30. As solenoid 44 of switch 30 rotates disk 40, the circuit through blower 22 and heater 24 is opened, turning off the unit 12. The toilet deodorizer device 10 is turned back on by flipping switch 32, a conventional single pole double throw switch, to the opposite position. When the flush lever L is next tilted to flush the toilet, the same process as described above is repeated until unit 12 is shut down. Rotary solenoid switch 30 always has a short between center wire 36 and one of the outside wires 34, 38 attached to switch 32. As shown in FIG. 5, the short is between center wire 36 and the wire 34, with one sector of rotation of contact disk 40 upon closing of switch 26 causing center wire 36 to short to the wire 38.

Expressed otherwise, switch 32 is employed to turn device 10 on, and switch 26 operates to turn off the device. A mercury switch is preferable as switch 26 for ease of installation, since such a switch can be merely clamped onto flush lever L inside tank T in a simple manner. The rotary solenoid switch 30, also of conventional construction, carries out the primary switching action to achieve the requisite time delay as described above. Switch 30, transformer 48, switch 32, and associated wiring will be contained in the control box 28 which hangs from the framework 18, as described above.

Blower 22 and heater 24 are off with switch 32 and contact disk 40 in the positions illustrated in FIG. 5, but can be actuated by moving switch 32 to the other position to that seen in FIG. 5. As described above, closing of switch 26 will actuate solenoid 44 in order to move the contacts of disk 40 to a position shorting out the circuit with the switch 32 in the opposite position from that shown.

As can be readily understood from the above description and from the drawings, th present invention permits apparatus to be provided which is capable of being assembled for providing a deodorizer device arrangeable in the upper portion of a conventional toilet tank. Such apparatus would include a diaphragm constructed from a preferably flexible sheet of gas permeable material adaptable to the shape of the top opening of a toilet tank, and a length of bendable strip material adaptable to be bent into a framework in the shape of the top opening of the toilet tank and affixed to the tank so as to clamp the diaphragm thereon. The strip of material so provided preferable has a cross section in the form of a right angle. All attachments can be achieved as by, for example, a suitable adhesive. The unit including the blower and heater can be affixed to the diaphragm at the factory, or subsequently attached thereto as desired, with the control box and mercury switch being easily attached to the framework formed from the strip and to the toilet flush lever, respectively, during installation of the device.

The foregoing is considered as illustrative only of the principles of the invention. Further, since numerous modificatons and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A toilet deodorizer device for use with a conventional toilet water tank and toilet bowl, the tank having an overflow pipe extending from the bottom of the tank and an upper portion provided with an open top, the device comprising, in combination:

(a) a flow inducing and odor removing means arrangeable in the upper portion of the tank for drawing fumes from the toilet bowl and into the overflow pipe for passage through the tank; and (b) retainer means mountable on the tank for supporting the flow inducing and odor removing means in the upper portion of the tank, wherein the retainer means further includes a diaphragm constructed from a gas permeable material and arrangeable extending across and completely blocking the open top of the tank, the flow inducing and odor removing means being disposed on the diaphragm for support thereby whereby said diaphragm prevents water in the tank from entering the flow inducing and odor removing means.

2. A structure as defined in claim 1, wherein the retainer means further includes an open framework shaped to conform to the top of the tank and to be supported thereon, with the diaphragm being attached to the framework, the framework having a cross section in the shape of a right angle and sealingly clamping the diaphragm on the upper portion of the tank.

3. A toilet deodorizer device for use with a conventional toilet water tank and toilet bowl, the tank having an overflow pipe extending from the bottom of the tank and an upper portion provided with an open top, the device comprising in combination:

(a) a flow inducing and odor removing means arrangeable in the upper portion of the tank for drawing fumes from the toilet bowl and into the overflow pipe for passage through the tank; and (b) retainer means mountable on the tank for supporting the flow inducing and odor removing means in the upper portion of the tank and for preventing water in the tank from entering the flow inducing and odor removing means, said retainer means including a diaphragm arrangeable extending across and blocking the open top of the tank, the flow inducing and odor removing means being disposed on the diaphragm for support thereby, the retainer means further including an open framework shaped to conform to the top of the tank and to be supported thereon, with the diaphragm being attached to the framework, the framework having a cross section in the shape of a right angle and sealingly clamping the diaphragm on the upper portion of the tank, the retainer means further including spacer means provided on the framework for spacing a cover of the tank from the framework and forming a gap for exhausting deodorized gases from the tank.

4. A structure as defined in claim 3, wherein the flow inducing and odor removing means includes, in combination:

(1) a fan;

(2) a heater associated with the fan, the fan and heater being disposed on the diaphragm;

(3) switch means mountable on a flush lever of the toilet tank and connected to the fan and heater for deenergizing the fan and heater when the toilet is flushed; and (4) control means connected to the fan and heater for permitting selective actuation of the deodorizer device and for interrupting a circuit to the fan and heater when the toilet is flushed.

5. A structure as defined in claim 4, wherein the fan is a centrifugal blower having an inlet and an outlet, with the heater comprising a heating element disposed at the outlet of the blower for deodorizing by use of heat fumes drawn through the blower.

6. Apparatus capable of being assembled for providing a deodorizer device arrangeable in the upper portion of a toilet tank including a flush valve actuating lever and an overflow pipe extending from the bottom of the tank toward an upper portion of the tank provided with an open top, the device arrangeable for drawing a flow of fume-laden gas through the tank from a toilet bowl associated with the tank and deodorizing the gas, the apparatus comprising, in combination:

(a) a diaphragm constructed from a sheet of gas permeable material and being shaped to completely cover the open top of the toilet tank;

(b) a length of bendable strip material being bent into a framework in the shape of the open top of the toilet tank and affixed to the diaphragm for clamping the diaphragm to the toilet tank; and (c) flow inducing and odor removing means including a unit comprising a blower and a heater, the unit being disposed on and supported by the diaphragm whereby said diaphragm prevents water in the tank from entering the flow inducing and odor removing means.

7. Apparatus as defined in claim 6, further including spacer means mounted on the framework formed by the strip material for spacing a cover of the toilet tank from the framework and forming a gap between the cover and framework for exhausting gas from the toilet tank.

* * * * *